US011545313B2

(12) United States Patent
Hoepfl et al.

(10) Patent No.: US 11,545,313 B2
(45) Date of Patent: Jan. 3, 2023

(54) LOAD TRANSFER SWITCH FOR ON-LOAD TAP CHANGER, AND ON-LOAD TAP CHANGER

(71) Applicant: Maschinenfabrik Reinhausen GmbH, Regensburg (DE)

(72) Inventors: Klaus Hoepfl, Maxhuette-Haidhof (DE); Silke Wrede, Zeitlarn (DE); Gregor Wilhelm, Regensburg (DE); Eduard Schmidt, Bad Abbach (DE); Stefan Herold, Munich (DE); Elke Wuersching, Regenstauf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 17/299,791

(22) PCT Filed: Nov. 12, 2019

(86) PCT No.: PCT/EP2019/081032
§ 371 (c)(1),
(2) Date: Jun. 4, 2021

(87) PCT Pub. No.: WO2020/114730
PCT Pub. Date: Jun. 11, 2020

(65) Prior Publication Data

US 2022/0044884 A1 Feb. 10, 2022

(30) Foreign Application Priority Data

Dec. 4, 2018 (DE) ..... 10 2018 130 869.8

(51) Int. Cl.
*H01H 9/00* (2006.01)
*H01F 29/04* (2006.01)
*H01H 3/42* (2006.01)

(52) U.S. Cl.
CPC ..... *H01H 9/0038* (2013.01); *H01F 29/04* (2013.01); *H01H 3/42* (2013.01); *H01H 9/0027* (2013.01); *H01H 9/0044* (2013.01)

(58) Field of Classification Search
CPC ..... H01H 9/0038; H01H 3/42; H01F 29/04
(Continued)

(56) References Cited

U.S. PATENT DOCUMENTS 3,467,800 A 9/1969 Barr
4,978,815 A 12/1990 Berger et al.
(Continued)

FOREIGN PATENT DOCUMENTS

DE 3833126 A1 4/1990
DE 102009043171 A1 4/2011
(Continued)

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

A diverter switch is for an on-load tap-changer. The diverter switch includes: at least one vacuum interrupter; an actuating element, which is mechanically connected at a first end of the vacuum interrupter and has a roller at a second end; and an actuating body having a base body and having at least one cam. The vacuum interrupter is configured to be actuated via the actuating element as a result of the roller moving over the actuating body. At least one part of the cam has a higher strength than the base body.

12 Claims, 3 Drawing Sheets

(58) Field of Classification Search
USPC ..... 323/340
See application file for complete search history.

(56) References Cited

U.S. PATENT DOCUMENTS

| | | | | |
|---|---|---|---|---|
| 6,313,726 | B1 * | 11/2001 | Golovatai-Schmidt | H01F 7/17 251/129.09 |
| 2012/0139510 | A1 * | 6/2012 | Wrede | G05F 1/10 323/258 |
| 2016/0155580 | A1 | 6/2016 | Fexixberger et al. | |
| 2016/0351356 | A1 * | 12/2016 | Reich | H01L 23/473 |
| 2019/0228922 | A1 * | 7/2019 | Stocker | H01H 9/0016 |

FOREIGN PATENT DOCUMENTS

| | | | |
|---|---|---|---|
| DE | 202012101543 | U1 | 5/2012 |
| DE | 102013107558 | A1 | 1/2015 |
| DE | 102016117526 | B3 | 2/2018 |
| WO | WO 2011035825 | A1 | 3/2011 |
| WO | WO 2012003863 | A1 | 1/2012 |

* cited by examiner

LOAD TRANSFER SWITCH FOR ON-LOAD TAP CHANGER, AND ON-LOAD TAP CHANGER

CROSS REFERENCE TO RELATED APPLICATIONS

This application is a U.S. National Phase application under 35 U.S.C. § 371 of International Application No. PCT/EP2019/081032 (WO 2020/114730 A1), filed on Nov. 12, 2019, and claims benefit to German Patent Application No. DE 10 2018 130 869.8, filed on Dec. 4, 2018.

FIELD

The present invention relates to a diverter switch for an on-load tap-changer, and an on-load tap-changer having such a diverter switch.

BACKGROUND

On-load tap-changers serve to carry out switching in tap-changing transformers. The switching takes place as a result of a mechanical actuation of different switches. With an increasing load, i.e. higher currents and voltages, the demands on the actuating mechanisms also increase.

SUMMARY

An embodiment of the present invention provides a diverter switch that is for an on-load tap-changer. The diverter switch includes: at least one vacuum interrupter; an actuating element, which is mechanically connected at a first end of the vacuum interrupter and has a roller at a second end; and an actuating body having a base body and having at least one cam. The vacuum interrupter is configured to be actuated via the actuating element as a result of the roller moving over the actuating body. At least one part of the cam has a higher strength than the base body.

BRIEF DESCRIPTION OF THE DRAWINGS

Subject matter of the present disclosure will be described in even greater detail below based on the exemplary figures. The invention defined by the following claims is not limited to the exemplary embodiments. All features described and/or illustrated herein can be used alone or combined in different combinations. The features and advantages of various embodiments will become apparent by reading the following detailed description with reference to the attached drawings, which illustrate the following:

DETAILED DESCRIPTION

Figure 1:
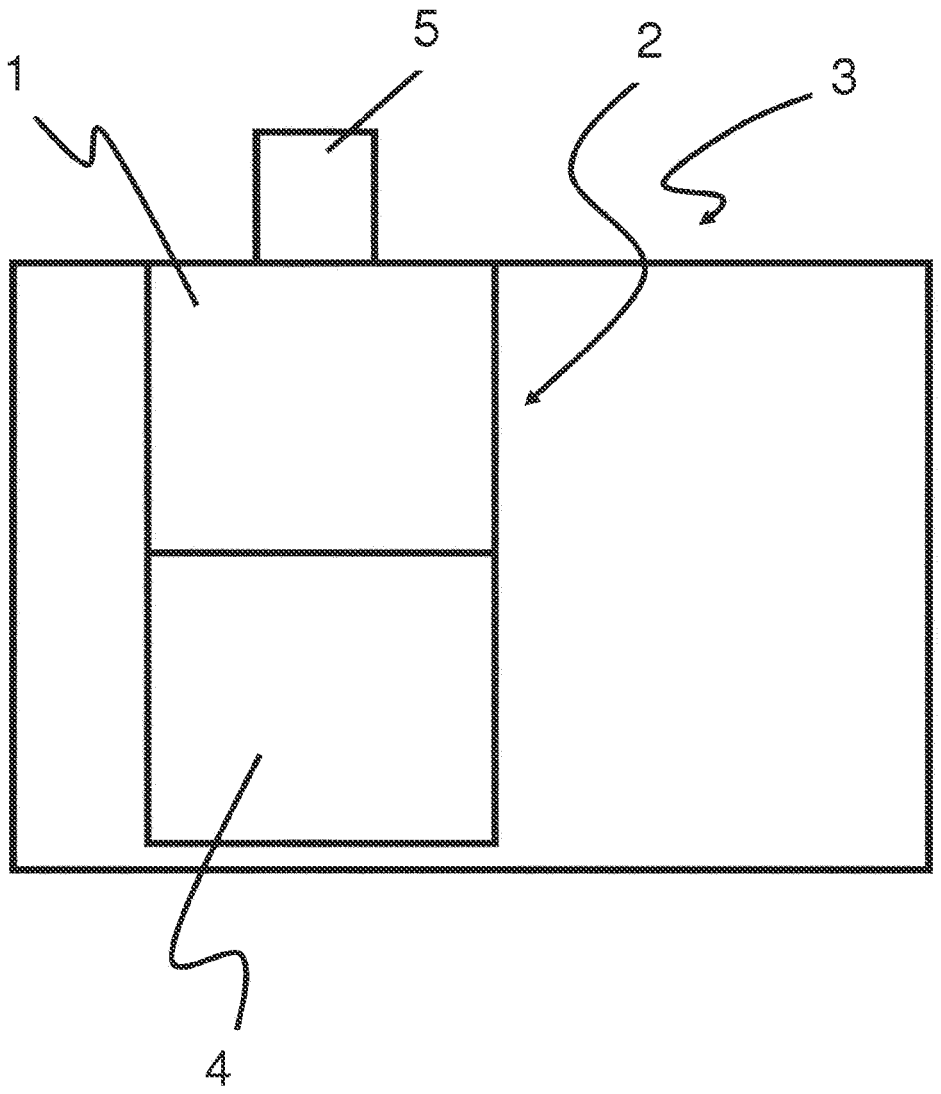
FIG. 1 shows a schematic illustration of a tap-changing transformer having an on-load tap-changer which comprises a diverter switch and a selector.

Embodiments of the present invention is provide an improved diverter switch for an on-load tap-changer, which withstands the high mechanical loads at higher currents and voltages whilst being safe and reliable.

Embodiments of the present invention provide an on-load tap-changer which withstands the high mechanical loads at higher currents and voltages whilst being safe and reliable.

An improved concept of embodiments of the present invention is based on the idea of constructing part of the cam (or the entire cam) of the actuating element from a harder material than that of the base body. Since a very high force has to be applied to open a vacuum interrupter under high currents, there is a risk that the cams will break as a result of the rollers moving over them. In this case, the highest load occurs at the part of the cam which is responsible for the "opening" of the vacuum interrupter, the so-called opening flank. For this reason, at least one part of the cam is constructed from a metal, in particular steel or heat treatable steel. This part is then at least as hard as the roller or has a higher or equal strength. To maintain the insulation spacings in the interior of the diverter switch, the base body of the actuating body is constructed from an insulating material, for example plastic or glass fiber reinforced plastic, and one part of the cam or the entire cam is constructed from a metal, in particular steel or heat treatable steel.

According to an improved concept of embodiments of the present invention, a diverter switch for an on-load tap-changer is provided, wherein the diverter switch comprises at least one vacuum interrupter. The diverter switch furthermore comprises an actuating element, which is mechanically connected at a first end of the vacuum interrupter and has a roller at a second end, and an actuating body having a base body and at least one cam. The vacuum interrupter is actuated via the actuating element as a result of the roller moving over the actuating body. At least one part of the cam has a higher strength than the base body.

The actuating element can be designed as a simple connecting piece between the moving contact and the roller. The actuating element can furthermore be constructed as a toggle lever. The actuating element transmits the force acting on a roller to the moving contact of the vacuum interrupter. The actuating body can have a disk-shaped, cylindrical or bar-shaped design. The cams can be arranged on the outer sides, or circumferentially, or on the upper side, or the underside. For the movement over the actuating body, this latter can be rotated, pivoted or displaced about one or more axes. The actuating element can furthermore be rotated, pivoted, or displaced for the movement over the cams.

According to at least one embodiment of the present invention, the vacuum interrupter is opened as a result of the movement over the at least one part of the cam. According to at least one embodiment of the present invention, the at least one part of the cam which opens the vacuum interrupter is an opening flank. According to at least one embodiment of the present invention, the base body consists of an insulating material, for example plastic or glass fiber reinforced plastic. According to at least one embodiment of the present invention, the at least one part of the cam or the entire cam consists of metal, in particular steel or heat treatable steel.

According to at least one embodiment of the present invention, the actuating body has a base body having four cams having four vacuum interrupters having a respective actuating element, wherein the four vacuum interrupters are arranged in a circle around the actuating body. In this case, the diverter switch can be designed to be single-phase, two-phase or three-phase, such that one to six vacuum interrupters are provided for each phase. The vacuum interrupters of a phase are arranged next to one another in one sector.

According to the improved concept of embodiments of the present invention, an on-load tap-changer has at least one diverter switch according to the improved concept of embodiments of the present invention.

The present invention is explained in detail below with the aid of exemplary embodiments and with reference to the drawings. Components which are functionally identical or have an identical effect can be denoted by identical reference signs. Identical components or components having an identical function are sometimes explained only with reference to the figure in which they first appear. The explanation is not necessarily repeated in the subsequent figures.

FIG. 1 shows a tap-changing transformer 3 having an on-load tap-changer 2, which has a diverter switch 1 and a selector 4. The on-load tap-changer 2 is driven by a motor 5.

Figure 2:
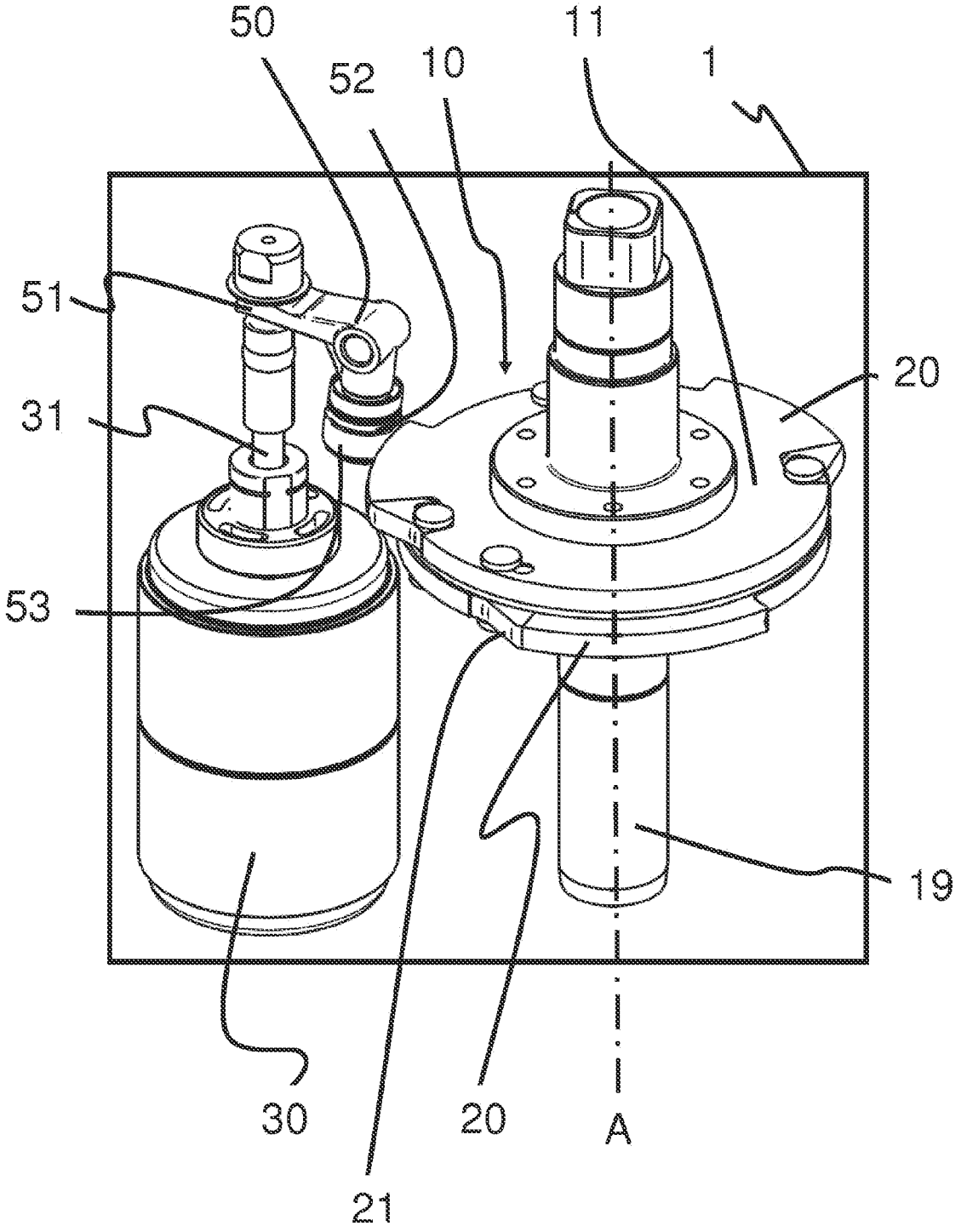
FIG. 2 shows an inventive diverter switch.

FIG. 2 shows the interior of an inventive diverter switch 1. An actuating body 10 having a base body 11 and a plurality of cams 20 is arranged in the center of the diverter switch 1. The actuating body 10 is mechanically connected to a drive shaft 19 in a torsion-resistant manner. The drive shaft 19 is connected to a spring energy accumulator or a motor-drive unit 5 and is actuated thereby. In this case, the drive shaft 19, and therefore the actuating body 10, is rotated about an axis A during operation. In this case, the drive shaft 19 is either rotated in one direction or back and forth through a fixed angle, i.e. forward and backward. The vacuum interrupter 30 is arranged around the actuating body 10 in a fixed manner. A plurality of vacuum interrupters having corresponding actuating mechanisms are conventionally arranged around an actuating body, for example in a circle.

The vacuum interrupter 30 has a moving contact 31 which is connected to an actuating element 50. The actuating element 50 of this embodiment is designed as a toggle lever. At its first end 51, the actuating element 50 is connected to the moving contact 31 of the vacuum interrupter 30. In the embodiment shown here, the first end 51 is constructed in a fork shape. At its second end 52, the actuating element 50 has a roller 53. Each of the vacuum interrupters of the diverter switch has an actuating element having a respective roller.

All parts of the diverter switch 1 are arranged in a housing. The housing can be constructed to be cylindrical or box-shaped for example.

Figure 3:
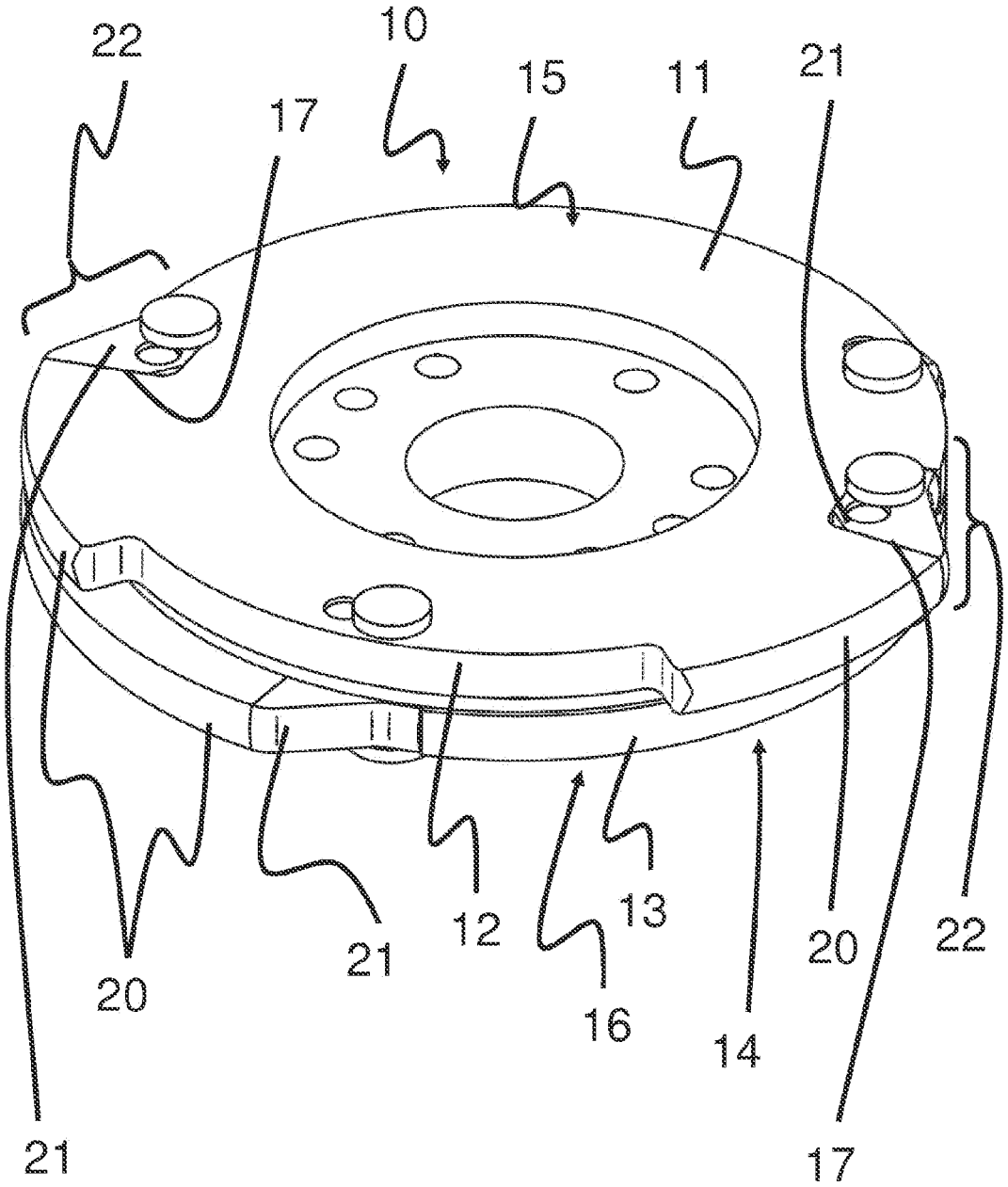
FIG. 3 shows an actuating body of the inventive diverter switch.

FIG. 3 shows a detailed illustration of the actuating body 10. The actuating body 10 has a base body 11 and a plurality of cams 20. In this case, the cams 20 are arranged on the lateral surface 14 of the actuating body 10, which has a substantially disk-shaped or cylindrical design. In the embodiment shown here, the actuating body 10 has a first actuating contour 12 and a second actuating contour 13 arranged immediately below the first actuating contour. Both actuating contours 12, 13 are arranged on the lateral surface 14 and extend over the entire circumference. The arrangement of one or more actuating contours on the upper side 15 or underside 16 of the actuating body 10 is likewise possible. The cams 20 are a component part of the actuating contours 12, 13.

In the embodiment shown here, one part 21 of the cam 20 consists of a different material to that of the base body 11. This part 21 of the cam 20 is the opening flank. This part 21 is connected to the base body 11 with form fit and/or force fit. This is realized by bonding and/or riveting and/or a screw connection. The part 21 can furthermore be inserted into a recess 17 in the base body 11. This part 21 preferably consists of metal, in particular steel or heat treatable steel. The base body 11 preferably consists of an insulating material, for example plastic or glass fiber reinforced plastic.

To actuate a vacuum interrupter 30, i.e. to open or close it, the roller 53 at the second end 52 of the actuating element 50 moves over an actuating contour 12, 13 of the actuating body 10. As the roller moves over the opening flank, i.e. the part 21 of the cam 20, the vacuum interrupter 30 is opened. The vacuum interrupter 30 is then held open by the further movement over the cam 20. In the example shown here, the cam 20 presses on the roller 53 of the actuating element 50. Since this is designed as a toggle lever, this is pivoted about a pivot axis and the first end 51 of the actuating element 50 pulls on the moving contact 31 of the vacuum interrupter 30 and opens this latter. To close the vacuum interrupter 30, the actuating body 10 is rotated contrary to the opening direction. As the roller rolls over the opening flank, the vacuum interrupter is closed 50.

The at least one part 21 of the cam 20 preferably consists of a material having a higher or equal strength to that of the roller 53.

In the example shown here, the actuating body 10 has a base body 11 and two actuating contours 12, 13 which are arranged on the lateral surface 14 and extend above one another. The first actuating contour 12 has two cams 20, which are used to actuate two vacuum interrupters 30. The second actuating contour 13 furthermore has two cams 20 which are used to actuate two further vacuum interrupters 30. One part 21 of each cam 20 has a higher strength than the base body 11. This part 21 is always the opening flank 22 by means of which the corresponding vacuum interrupter 30 is opened as a result of a roller 53 moving over it. The individual cams 20 of the respective actuating contours can be offset from one another.

While subject matter of the present disclosure has been illustrated and described in detail in the drawings and foregoing description, such illustration and description are to be considered illustrative or exemplary and not restrictive. It will be understood that changes and modifications may be made by those of ordinary skill within the scope of the following claims. In particular, the invention defined by the following claims may cover further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Diverter switch
2 On-load tap-changer
3 Tap-changing transformer
4 Selector

10 Actuating body
11 Base body
12 First actuating contour
13 Second actuating contour
14 Lateral surface
15 Upper side of 10
16 Underside of 10
17 Recess
19 Drive shaft
20 Cam
21 Part of a cam
22 Opening flank
30 Vacuum interrupter
31 Moving contact
50 Actuating element
51 First end
52 Second end
53 Roller

The invention claimed is:

1. A diverter switch for an on-load tap-changer, the diverter switch comprising:

at least one vacuum interrupter;

an actuating element, which is mechanically connected at a first end of the vacuum interrupter and has a roller at a second end; and an actuating body having a base body and having at least one cam, wherein:

the vacuum interrupter is configured to be actuated via the actuating element as a result of the roller moving over the actuating body, and at least one part of the cam has a higher strength than the base body.

2. The diverter switch as claimed in claim 1, wherein the vacuum interrupter is configured to open due to a movement of the at least one part of the cam that has the higher strength than the base body.

3. The diverter switch as claimed in claim 1, wherein the at least one part of the cam that has the higher strength than the base body is an opening flank of the cam, which is configured to move to open the vacuum interrupter.

4. The diverter switch as claimed in claim 1, wherein the base body consists of an insulating material.

5. The diverter switch as claimed in claim 1, wherein the at least one part of the cam that has the higher strength than the base body consists of metal.

6. The diverter switch as claimed in claim 1, wherein:

the actuating body has the base body and four cams, the four cams comprising the at least one cam, four vacuum interrupters, which comprise the vacuum interrupter, having a respective one of four actuating elements, which comprise the actuating element, and the four vacuum interrupters are arranged in a circle around the actuating body.

7. An on-load tap-changer comprising the diverter switch as claimed in claim 1.

8. The diverter switch as claimed in claim 1, wherein the at least one part of the cam that has a higher strength than the base body is constructed from a harder material than that of the base body.

9. The diverter switch as claimed in claim 1, wherein the cam comprises an opening flank that is configured to mechanically interface with the roller in order to move open the vacuum interrupter, wherein the opening flank consists of a metal, wherein the base body is constructed from an insulating material.

10. The diverter switch as claimed in claim 9, wherein the opening flank is constructed of steel.

11. The diverter switch as claimed in claim 9, wherein the opening flank comprises a material that is as hard or harder than that of the roller.

12. The diverter switch as claim in claim 1, wherein the entire cam is constructed from a metal.

* * * * *